US006185841B1

(12) United States Patent
Conochie

(10) Patent No.: US 6,185,841 B1
(45) Date of Patent: Feb. 13, 2001

(54) ENHANCED HEAT TRANSFER SYSTEM

(75) Inventor: David Stewart Conochie, Camberwell (AU)

(73) Assignee: KFx Inc., Denver, CO (US)

( * ) Notice: Under 35 U.S.C. 154(b), the term of this patent shall be extended for 0 days.

(21) Appl. No.: 09/403,679

(22) PCT Filed: May 6, 1998

(86) PCT No.: PCT/AU98/00324

§ 371 Date: Feb. 8, 2000

§ 102(e) Date: Feb. 8, 2000

(87) PCT Pub. No.: WO98/50743

PCT Pub. Date: Nov. 12, 1998

(30) Foreign Application Priority Data

May 7, 1997 (AU) ..... PO6632

(51) Int. Cl.[7] ..... F26B 3/00

(52) U.S. Cl. ..... 34/337; 34/348; 34/357; 34/363; 34/562; 34/586; 34/588; 34/181; 34/187

(58) Field of Search ..... 34/329, 330, 337, 34/343, 348, 351, 357, 363, 378, 487, 562, 576, 586, 588, 589, 181, 182, 187, 201, 205; 165/104.16, 104.18; 110/346, 347

(56) References Cited

U.S. PATENT DOCUMENTS

| | | | | |
|---|---|---|---|---|
| 4,052,168 | | 10/1977 | Koppelman . | |
| 4,307,773 | * | 12/1981 | Smith | 165/1 |
| 4,506,453 | * | 3/1985 | Shirley, Jr. et al. | 34/363 |
| 4,601,113 | | 7/1986 | Draper et al. . | |
| 4,734,165 | | 3/1988 | Bauer et al. . | |
| 5,290,523 | | 3/1994 | Koppelman . | |
| 5,353,517 | | 10/1994 | Weiss . | |
| 5,363,812 | * | 11/1994 | Belin et al. | 165/104.16 X |
| 5,470,544 | * | 11/1995 | Galloway | 422/213 |
| 5,526,582 | * | 6/1996 | Isaksson | 34/363 X |
| 6,032,932 | * | 3/2000 | Sixsmith | 261/111 |

OTHER PUBLICATIONS

PCT International Search Report, International Appln. No. PCT/AU98/00324, Int'l Filing Date: May 6, 1998.

PCT International Preliminary Examination Report (PCT/AU98/00324).

* cited by examiner

*Primary Examiner*—Stephen Gravini
(74) *Attorney, Agent, or Firm*—Harness, Dickey & Pierce, P.L.C.

(57) ABSTRACT

A method and apparatus for heating or cooling a solid material (93) in a process vessel (80) is disclosed. The Method includes supplying a working fluid to a vessel which holds a packed bed (93) of the solid material. The method is characterised by reversing the flow of the working fluid to enhance heat transfer between a heat exchange fluid and the solid material.

27 Claims, 1 Drawing Sheet

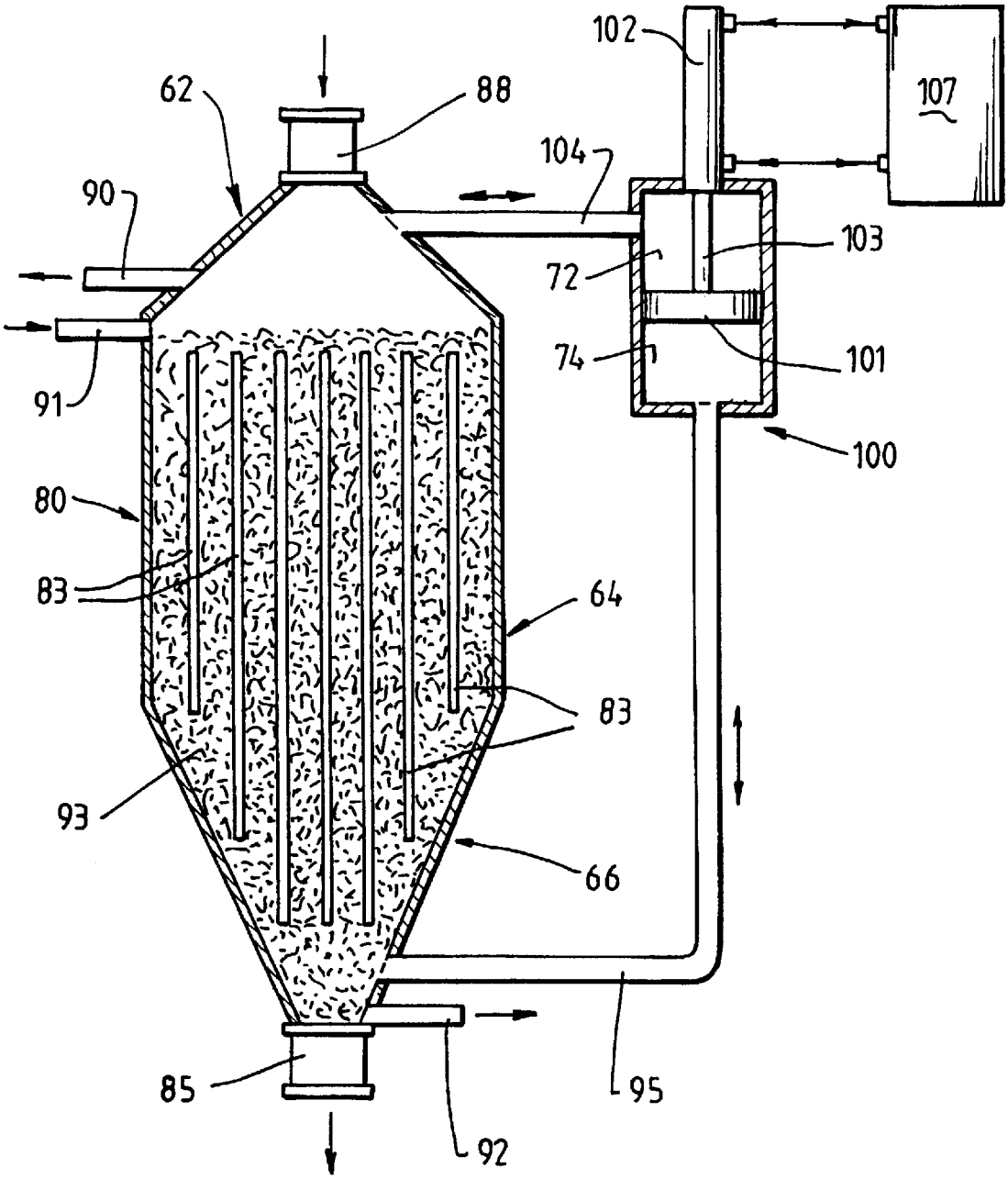
102
107
62
88
104
90
103
72
74
101
91
100
80
83
64
83
93
66
85
95
92

ENHANCED HEAT TRANSFER SYSTEM

The present invention relates to processing a charge of a solid material to heat or cool the solid material.

The present invention relates particularly, although not exclusively, to processing a charge of a solid material, the charge having low thermal conductivity, under conditions including high temperature and pressure.

The present invention relates more particularly to:

(i) upgrading carbonaceous materials, typically coal, under conditions including high temperature and pressure to increase the BTU value of the carbonaceous materials by removing water from the carbonaceous materials; and (ii) cooling the heated carbonaceous materials.

U.S. Pat. No. 5,290,523 to Koppelman discloses a process for upgrading coal by the simultaneous application of temperature and pressure.

Koppelman discloses thermal dewatering of coal by heating coal under conditions including elevated temperature and pressure to cause physical changes in the coal that results in water being removed from the coal by a "squeeze" reaction.

Koppelman also discloses maintaining the pressure sufficiently high during the upgrading process so that the by-product water is produced mainly as a liquid rather than steam.

Koppelman also discloses a range of different apparatus options for carrying out the upgrading process. In general terms, the options are based on the use of a pressure vessel which includes an inverted conical inlet, a cylindrical body, a conical outlet, and an assembly of vertically or horizontally disposed heat exchange tubes positioned in the body.

In one proposal to use a Koppelman-type apparatus, the vertically disposed tubes and the outlet end are packed with coal, and nitrogen is injected to pressurise the tubes and the outlet end. The coal is heated by indirect heat exchange with a heat exchange fluid supplied to the cylindrical body externally of the tubes. Further heat transfer is promoted by supplying water to the tubes, which subsequently forms steam that acts as a heat transfer fluid. The combination of elevated pressure and temperature conditions evaporates some of the water from the coal and thereafter condenses some of the water as a liquid. A portion of the steam generated following the addition of water also condenses as a liquid due to the elevated pressure. Steam which is not condensed, and which is in excess of the requirements for optimum pressurisation of the packed bed, must be vented. In addition, non-condensable gases (eg CO, $CO_2$) are evolved and need to be vented. Periodically, liquid is drained from the outlet end. Finally, after a prescribed residence tine, the vessel is depressurised and the upgraded coal is discharged via the outlet end and subsequently cooled.

International applications PCT/AU98/00005 entitled "A Reactor", PCT/AU98/00142 entitled "Process Vessel and Method of Treating a Charge of Material", and PCT/AU98/00204 entitled "Liquid/Gas/Solid Separation" in the name of the applicant disclose inter alia an improved process for upgrading coal by the simultaneous application of temperature and pressure to that described by Koppelman.

International application PCT/AU98/00142 is particularly relevant in the context of the present invention. The International application discloses that the applicant found that enhanced heat transfer could be achieved in heating or cooling a charge of coal or other solid material having a low thermal conductivity in a pressure vessel by utilising a working fluid that is forced to flow through the vessel from an inlet end to an outlet end by virtue of an applied pressure and is recirculated to the inlet end. The preferred embodiment shown in FIG. 7 of the International application is based on the use of a centrifugal fan located externally of the vessel as the means of applying the required pressure to create flow of the working fluid.

An object of the present invention is to provide an improved process and apparatus for upgrading coal by the simultaneous application of temperature and pressure to that described by Koppelman and in the above International applications.

According to the present invention there is provided a method of heating or cooling a solid material in a process vessel, which method comprises:

(a) supplying a charge of the solid material to the vessel to form a packed bed;

(b) supplying a working fluid to the vessel;

(c) heating or cooling the solid material by heat exchange with a heat exchange fluid via internal heat transfer surfaces in the packed bed, whereby indirect heat exchange occurs between the heat transfer fluid and the charge and between the heat transfer fluid and the working fluid, and whereby direct heat exchange occurs between the working fluid and the charge; and (d) enhancing heat exchange during heating or cooling step (c) by reversing flow of the working fluid by:

(i) causing the working fluid to flow in a first direction for a first period of time;

(ii) causing the working fluid to flow in a second direction for a second period of time; and (iii) repeating steps (i) and (ii).

The above described heat exchange enhancing step (d) is hereinafter referred to as "reversing flow" of the working fluid.

It is preferred that the second direction be opposite to the first direction.

The present invention is based on the realisation that reversing flow of the working fluid can significantly enhance indirect heat exchange between the heat exchange fluid and the solid material and that the energy requirements for reversing flow of the working fluid are relatively low.

It is preferred that the method further comprises pressurising the packed bed prior to or during heating or cooling step (c) with externally supplied gas, internally generated steam, or both.

It is preferred particularly that the method further comprises pressurising the packed bed prior to or during heating or cooling step (C) to an operational pressure up to 800 psig.

It is preferred that the working fluid be a gas.

In situations where the working fluid is a gas, because the working fluid is compressible and the packed bed has resistance to flow, some of the flow will be stored as compressed gas in the vessel (and any associated pipework). The extent of this capacitance effect is dependent on a range of factors, such as particle size in the packed bed, operating pressure, mass flow, frequency, and compressible volume. It is preferred that the system be designed so that the capacitance effect accounts for less than 10% of mass flow of the working fluid.

It is preferred that the working gas does not undergo a phase change in the operating conditions of the method. It is noted that in some instances there may be a benefit in using a working gas that contains a condensable component.

Gases that may be used as the working gas include oxygen, nitrogen, steam, $SO_2$, $CO_2$, hydrocarbons, noble gases, refrigerants, and mixtures thereof.

It is preferred that the working fluid be unreactive with the bed.

It is preferred that the frequency of reversing flow be less than 10 HZ and, more preferably, less than 3 HZ. It is preferred particularly that the frequency of reversing flow be less than 2 HZ.

The duration of the first and second time periods of reversing flow may be the same so that there is no net flow of the working fluid through the vessel. Alternatively, the duration of the first and second periods of time may be different so that there is a net flow of the working fluid through the vessel which produces a net circulating flow of the working fluid in the vessel.

The reversing flow of the working fluid may be a series of successive steps with the flow in the second direction immediately following the flow in the first direction and these steps being repeated immediately thereafter. The reversing flow of the working fluid may also be any suitable variation. For example, there may be a pause between the reversing of the flow between the first and second directions. By way of further example, there may be a pause after the flow in one direction and thereafter further flow in the same direction before reversing the flow to the opposite direction. By way of further example, there may be flow in one direction, followed by a pause, and further flow in the same direction. This variation produces a net circulating flow of the working fluid in the vessel.

As noted above, the present invention is directed particularly to heating and cooling carbonaceous material, typically coal. In use of the method for this purpose, it is preferred that the heating step comprise:

(a) heating the carbonaceous material to a temperature $T_1$ by indirect heat exchange with the heat exchange fluid and without enhancing the heat exchange by reversing flow of the working fluid; and (b) heating the carbonaceous material to a higher temperature $T_2$ by indirect heat exchange with the heat exchange fluid and by enhancing the heat exchange by reversing flow of the working fluid.

It is preferred particularly that the heating step comprise:

(a) heating the carbonaceous material to a temperature $T_0$ by indirect heat exchange with the heat exchange fluid and by enhancing the heat exchange by reversing flow of the working fluid;

(b) heating the carbonaceous material to a higher temperature $T_1$ by indirect heat exchange with the heat exchange fluid and without enhancing the heat exchange by reversing flow of the working fluid; and (c) heating the carbonaceous material to a higher temperature $T_2$ by indirect heat exchange with the heat exchange fluid and by enhancing the heat exchange by reversing flow of the working fluid.

It is preferred that the temperature $T_0$ be at or around the temperature at which water commences to exude from the carbonaceous material.

It is preferred that the temperature $T_1$ be at or around the boiling point of water at the process pressure in the vessel.

It is preferred that the reversing flow of the working fluid be caused by a pump assembly.

It is preferred that the pump assembly comprise:

(a) a pump housing:

(b) a piston slidably positioned in the pump housing and dividing the pump housing into a first chamber and a second chamber, each chamber having an opening for the working fluid to flow into and from the chamber;

(c) a means to move the piston axially in opposite directions in the pump housing to increase the volume in one of the chambers and to decrease the volume in the other of the chambers;

(d) a conduit connected to each chamber opening, each conduit having an inlet/outlet in the vessel, and the inlet/outlet of the conduit from the first chamber being spaced apart from the inlet/outlet of the conduit from the second chamber.

It can readily be appreciated that with the above described arrangement axial movement of the piston in one direction pumps the working fluid from the first chamber into the vessel via the associated inlet/outlet and draws the working fluid from the vessel into the second chamber via the associated inlet/outlet. Furthermore, subsequent axial movement of the piston in the opposite direction pumps the working fluid from the second chamber into the vessel via the associated inlet/outlet and draws the working fluid from the vessel into the first chamber via the associated inlet/outlet. Successive axial movement of the piston in opposite directions causes successive reversing flow of the working fluid in the vessel.

The results of computer modelling work carried out by the applicant indicate that mass flow rate of the working fluid per unit cross-sectional area of the packed bed is the prime determinant of heat transfer rate. In a situation where reversing flow of the working fluid is caused by the pump assembly described in sub-paragraphs (a) to (d) above, the factors that affect the mass flow rate of the working fluid include, but are not limited to, the frequency of reversing flow, the swept volume of the chambers, the piston velocity, and the density of the working fluid. It can readily be appreciated that these factors may be selected as required for a given vessel configuration to maximise the heat transfer rate for that vessel.

The pump assembly may be located inside or outside the vessel.

When the pump assembly is located inside the vessel, the pump housing may be in any suitable location in the vessel. For example, the pump housing may be located in an upper section of the vessel. By way of further example, the pump housing may be located in a lower section of the vessel partially or wholly submerged in water exuded from the solid material in operation of the method.

When the pump assembly is located outside the vessel, the pump housing may be in any suitable location. For example, the pump housing may be arranged so that one of the chambers is partially or wholly filled with water exuded from the solid material in operation of the method.

It is preferred that the inlets/outlets of the first and second chambers be spaced apart axially in the vessel so that in a general sense (and bearing in mind localised tortuous flow of the working fluid around the solid material in the packed bed) the reversing flow in the packed bed is axial.

It is preferred that the inlets/outlets of the first and second chambers be located in the upper and the lower sections, respectively, of the vessel.

It is preferred that there be a plurality of pump assemblies arranged in series with the inlets/outlets spaced along the length of the packed bed so that each pump assembly causes reversing flow in a different axial section of the bed. With this arrangement it is preferred that adjacent pump assemblies be arranged to operate out of phase to provide reversing flow of the working fluid.

In an alternative arrangement it is preferred that there be a plurality of pump assemblies arranged in parallel.

In a variation of the pump assembly described above, instead of the piston moving means being arranged to move the piston alternately in opposite directions in the pump housing, it is preferred that the piston moving means be arranged to move the piston in one direction only. This uni-action variation relies on compressibility of the working fluid in the vessel (or in an associated chamber in fluid communication with the vessel) to store the working fluid at increased pressure and drive the reverse action of the piston.

In the uni-action variation it is preferred that the pump assembly comprise:

(a) a pump housing;

(b) a piston slidably positioned in the pump housing, the pump housing and the piston defining a pump chamber, the pump chamber having an opening for the working fluid to flow into and from the chamber;

(c) a means for moving the piston axially in the pump housing to decrease the volume of the chamber thereby to force the working fluid from the chamber; and (d) a conduit connected to the chamber opening and having an inlet/outlet in the vessel.

According to the present invention there is also provided an apparatus for heating or cooling a charge of a solid material, which apparatus comprises:

(a) a vessel defining an internal volume, the vessel having:

(i) an inlet end having an inlet for the solid material; and (ii) an outlet end having an outlet for the solid material;

(b) a plurality of heat transfer surfaces in the vessel;

(c) a means for supplying a heat exchange fluid to the vessel for heating or cooling the solid material in the vessel by indirect heat exchange via the heat transfer surfaces;

(d) a means for enhancing heat exchange during heating or cooling by:

(i) causing a working fluid to flow in contact with the solid material in the vessel in a first direction for a first period of time;

(ii) causing the working fluid to flow in contact with the solid material in the vessel in a second direction which is opposite to the first direction for a second period of time; and (iii) successively reversing the flow of the working fluid for the first and second time periods.

It is preferred that the apparatus further comprise a means for supplying a fluid to pressurize the vessel.

It is preferred that the means for causing the reversing flow of the working fluid comprise the pump assembly described above.

The present invention is described further by way of example with reference to the accompanying drawing which is a schematic diagram of a preferred embodiment of an apparatus for heating a solid material in accordance with the present invention.

The following description is in the context upgrading coal. It is noted that the present invention is not limited to this application and extends to processing any suitable solid material.

With reference to the figure, the apparatus comprises a pressure vessel 80 having an inverted conical inlet 62, a cylindrical body 64, a conical outlet 66, and an assembly of vertically disposed heat exchange plates 83 positioned in the body 64 and the conical outlet 66. The plates 83 are of the type disclosed in International application PCT/AU98/00005 and comprise channels and manifolds (not shown) for a heat exchange fluid, such as oil.

The conical inlet 62 comprises:

(i) a valve assembly 88 for allowing coal to be supplied to the vessel 80 to form a packed bed 93 in the vessel;

(ii) a gas/liquid inlet means 91 for supplying to the vessel 80 a working gas to enhance heat exchange and a gas/liquid to pressurise the vessel; and (iii) a gas outlet 90 for allowing gas to be vented from the vessel 80 if the pressure in the vessel 80 reaches a predetermined level.

The conical outlet 66 comprises a valve 85 for allowing processed coal to be discharged from the vessel 80, and a gas/liquid outlet 92 for discharging gas and liquid from the vessel 80. One configuration of the conical outlet 66 with respect to gas/liquid/solids separation is as described in International application PCT/AU98/00204.

The apparatus is adapted to process coal on a batch basis. However, it is noted that the present invention is not so limited and extends to continuous processing of coal (and other solid material).

The apparatus further comprises a means for enhancing heat exchange between the heat exchange fluid flowing through the channels (not shown) in the plates 83 and the coal in the packed bed 93 by causing a reversing flow of the working fluid in the vessel 80. In the context of the preferred embodiment the reversing flow is successive upward and downward movement of the working gas in the packed bed 93 for relatively short time periods. It is noted that the description of the movement of the working gas as "upward" and "downward" should be understood in the general sense and that the arrangement of coal in the packed bed 93 causes the working gas to move on a tortuous path on a local level. In any event, as is noted above, the applicant has found in computer modelling work that reversing flow of the working gas in the vessel 80 significantly enhances heat transfer to a comparable level to that achieved by circulating flow of the working fluid as proposed in International application PCT/AU98/00142. In particular, the computer modelling work indicated that relatively low frequency reversing flow (preferably <10 HZ, more preferably <3 HZ, typically, 2 HZ) provided optimal enhancement of heat transfer in processing of coal.

The heat exchange enhancement means comprises a pump assembly which includes a double acting piston 101 located in a pump housing 100. The piston 101 divides the pump housing 100 into two chambers 72, 74. The piston 101 is connected via a connecting rod 103 to a long travel hydraulic piston/cylinder assembly 102 which is powered by a hydraulic pump 107. The hydraulic pump 107 may be powered by any suitable means. By way of example, the hydraulic pump 107 may be powered at least in part by pressure of gas vented from the vessel 80 via gas outlet 90. Hydraulic fluid is supplied to the piston/cylinder assembly 102 via lines 106. The arrangement is such that the hydraulic pump 107 causes the piston 101 to move alternately downwardly and upwardly in the pump housing 100 to alternately increase and decrease the volume of the chambers 72, 74. The chamber 72 is connected to the conical inlet 62 of the vessel 80 via a conduit 104 and the chamber 74 is connected to the conical outlet 66 of the vessel 80 via a conduit 95. The arrangement is such that, in use, movement of the piston 101:

(i) forces the working gas from the chamber 72 into the conical inlet 62 of the vessel 80 as the chamber 72 contracts; and (ii) draws the working gas into the chamber 74 from the conical outlet 66 of the vessel 80 as the chamber 74 expands.

Similarly, successive downward movement of the piston 101 forces the working gas from the chamber 74 into the conical outlet 66 as the chamber 74 contracts and draws the working gas into the chamber 72 from the conical inlet 66 of the vessel 80 as the chamber 72 expands.

The net effect of the alternate upward and downward movement of the piston 101 is to cause alternate downward and upward flow (ie. reversing flow) of the working gas in the vessel 80.

The use of reversing flow of the working gas has a number of advantages. For example, the equipment requirements to achieve reversing flow can be significantly less complex than for circulating flow of the working gas by means of a centrifugal fan as proposed in International application PCT/AU98/00142. By way of example, the pumping assembly shown in the figure may be a valveless positive displacement pump with minimal requirements for high pressure seals which could be expected to be relatively maintenance-free.

In a preferred embodiment of the method of the present invention to heat coal using the apparatus shown in the figure, the packed bed 93 of coal is formed in the vessel 80 by supplying a charge of coal via the inlet valve 88 and the working gas via the gas/liquid inlet 91. Thereafter, the vessel 80 is pressurised by supplying a suitable gas via the gas/liquid inlet 91, and heat exchange fluid at an elevated temperature is passed through the channels (not shown) in the plates 83.

As a consequence, the coal is heated and water is "squeezed" from the coal by the mechanisms described by Koppelman and in the above-referenced International applications. In a first phase, prior to water being exuded from the coal, the pump assembly is operated to cause reverse flow of the working gas in the vessel to enhance heat transfer. In a second phase, during which water is exuded from the coal by the "squeeze" mechanisms, reverse flow of the working gas is not required and therefore the pump assembly is not operated. In a third phase, after substantial removal of the water from the coal, the pump assembly is operated to enhance heat transfer by reverse flow of the working gas as the coal is heated to a final process temperature.

Many modifications may be made to the preferred embodiment described above without departing from the spirit and scope of the present invention.

By way of example, whilst the preferred embodiment of the heat exchange enhancement means described above includes a double acting piston 101 located in a pump housing 100 external to the vessel 80 and connected to upper and lower sections of the vessel 80, it can readily be appreciated that the present invention is not so limited and extends to any suitable device for causing reversing flow of working fluid. Suitable alternatives include:

(i) multiple reversing flow devices in parallel, operating in phase;

(ii) self-driven reversing flow devices which vent working fluid to drive the piston;

(iii) single connection to the vessel to provide reversing flow by storing working fluid in the packed bed and in a chamber at the far end of the bed;

(iv) valves in the pump assembly to make it unidirectional;

(v) incorporating a non-return valve in the piston to allow a creeping reversing flow which may be used to enhance drainage from the packed bed with flow of working fluid; and (vi) a pump with separate valving means to create reversing flow.

By way of further example, it is within the scope of the present invention to cause reversing flow by means other than the above-described pump-based options. One alternative is to depressurise and/or pressurise the vessel 80 with water injection and appropriate venting of the vessel.

By way of further example, whilst the preferred embodiment of the heat exchange enhancement means described above is described in the context of a single vessel 80, it can readily be appreciated that the present invention is not so limited and extends to arrangements in which the heat exchange enhancement means is connected to a series of vessels 80.

I claim:

1. A method of heating or cooling a solid material in a process vessel, which method comprises:

(a) supplying a charge of the solid material to the vessel to form a packed bed;

(b) supplying a working fluid to the vessel;

(c) heating or cooling the solid material by heat exchange with a heat exchange fluid via internal heat transfer surfaces in the packed bed, whereby indirect heat exchange occurs between the heat transfer fluid and the charge and between the heat transfer fluid and the working fluid, and whereby direct heat exchange occurs between the working fluid and the charge; and (d) enhancing heat exchange during heating or cooling step (c) by reversing flow of the working fluid by:

(i) causing the working fluid to flow in a first direction for a first period of time;

(ii) causing the working fluid to flow in a second direction for a second period of time; and (iii) repeating steps (i) and (ii).

2. The method defined in claim 1 wherein the second direction is opposite to the first direction.

3. The method defined in claim 1 further comprising pressurizing the packed bed prior to step (c) with externally supplied gas.

4. The method defined in claim 1 wherein the working fluid is a gas.

5. The method defined in claim 1 wherein a frequency of reversing flow is less than 10 HZ.

6. The method defined in claim 5 wherein the reversing flow frequency is less than 3 HZ.

7. The method defined in claim 1 wherein a duration of the first and second time periods of reversing flow is the same so that there is no net flow of the working fluid through the vessel.

8. The method defined in claim 1 wherein durations of the first and second time periods of reversing flow are different so that there is a net flow of the working fluid through the vessel which produces a net circulating flow of the working fluid in the vessel.

9. The method defined in claim 1 wherein reversing flow of the working fluid occurs in a series of successive steps with the flow in the second direction immediately following the flow in the first direction and these steps being repeated immediately thereafter.

10. The method defined in claim 1 wherein there is a pause between flow in the first direction and flow in the second direction.

11. The method defined in claim 1 wherein there is a pause after flow in one direction and thereafter further flow in the same direction before reversing flow to the opposite direction.

12. An apparatus for heating or cooling a charge of a solid material, which apparatus comprises:

(a) a vessel defining an internal volume, the vessel having:

(i) an inlet end having an inlet for the solid material; and (ii) an outlet end having an outlet for the solid material;

(b) a plurality of heat transfer surfaces in the vessel;

(c) an inlet for supplying a heat exchange fluid to the vessel for heating or cooling the solid material in the vessel by indirect heat exchange via the heat transfer surfaces; and (d) a working fluid flow control element for (i) causing the working fluid to flow in contact with the solid material in the vessel in a first direction for a first period of time;

(ii) causing the working fluid to flow in contact with the solid material in the vessel in a second direction for a second period of time; and (iii) successfully reversing the flow of the working fluid for the first and second time periods.

13. The apparatus defined in claim 12 further comprising an inlet for supplying a fluid to pressurise the vessel.

14. The apparatus defined in claim 12 wherein the flow control element comprises a pump assembly.

15. The apparatus defined in claim 14 wherein the pump assembly comprises:

(a) a pump housing:

(b) a piston slidably positioned in the pump housing and dividing the pump housing into a first chamber and a second chamber, each chamber having an opening for the working fluid to flow into and from the chamber;

(c) a means to move the piston axially in opposite directions in the pump housing to increase the volume in one of the chambers and to decrease the volume in the other of the chambers;

(d) a conduit connected to each chamber opening, each conduit having an inlet/outlet in the vessel, and the inlet/outlet of the conduit from the first chamber being spaced apart from the inlet/outlet of the conduit from the second chamber.

16. The apparatus defined in claim 15 wherein the pump assembly is located outside the vessel.

17. The apparatus defined in claim 15 wherein the pump assembly is located inside the vessel.

18. The apparatus defined in claim 17 wherein the inlets/outlets of the first and second chambers are spaced apart axially in the vessel so that in a general sense the reversing flow in the packed bed is axial.

19. The apparatus defined in claim 18 wherein the inlets/outlets of the first and second chambers are located in the upper and the lower sections of the vessel.

20. The apparatus defined in claim 18 comprises a plurality of pump assemblies arranged in series with the inlets/outlets spaced along the length of the packed bed so that each pump assembly causes reversing flow in a different axial section of the bed.

21. The apparatus defined in claim 20 wherein adjacent pump assemblies are arranged to operate out of phase to provide reversing flow of the working fluid.

22. The apparatus defined in claim 18 wherein there are a plurality of pump assemblies arranged in parallel.

23. The method defined in claim 1 further comprising pressurizing the packed bed prior to step (c) with internally generated steam.

24. The method defined in claim 1 further comprising pressurizing the packed bed prior to step (c) with externally supplied gas and internally generated steam.

25. The method defined in claim 1 further comprising pressurizing the packed bed prior to step (c) with externally supplied gas.

26. The method defined in claim 1 further comprising pressurizing the packed bed during step (c) with internally generated steam.

27. The method defined in claim 1 further comprising pressurizing the packed bed during step (c) with externally supplied gas and internally generated steam.

* * * * *

UNITED STATES PATENT AND TRADEMARK OFFICE

CERTIFICATE OF CORRECTION

PATENT NO. : 6,185,841 B1
DATED : February 13, 2001
INVENTOR(S) : David Stewart Conochie It is certified that error appears in the above-identified patent and that said Letters Patent is hereby corrected as shown below:

Column 1,
Line 51, "tine" should be -- time --.

Column 5,
Line 50, after "context" insert -- of --.

Signed and Sealed this

Ninth Day of April, 2002

*Attest:*

*Attesting Officer*

JAMES E. ROGAN
*Director of the United States Patent and Trademark Office*